United States Patent [19]

Bowden, Jr. et al.

[11] Patent Number: 4,797,988

[45] Date of Patent: Jan. 17, 1989

[54] METHOD AND TOOL FOR PREPARING MULTI-CONDUCTOR CABLE

[75] Inventors: Wade R. Bowden, Jr., Northport; Yuliy Rushansky, Port Washington, both of N.Y.

[73] Assignee: Slater Electric, Inc., Glen Cove, N.Y.

[21] Appl. No.: 844,841

[22] Filed: Mar. 27, 1986

[51] Int. Cl.[4] ..... H01R 43/04

[52] U.S. Cl. ..... 29/566.4; 7/134; 7/131; 29/751; 29/752; 29/758

[58] Field of Search ..... 29/566.4, 750, 751, 29/752, 758, 33 M; 7/131, 134

[56] References Cited

U.S. PATENT DOCUMENTS

| | | | |
|---|---|---|---|
| 435,414 | 9/1890 | Fisher . | |
| 1,018,839 | 2/1912 | Mann | 7/134 X |
| 1,453,634 | 4/1923 | Bell . | |
| 2,513,128 | 6/1950 | Wright et al. | 7/131 X |
| 3,174,723 | 3/1965 | McGuire | 254/131 |
| 3,177,741 | 4/1965 | De Bruin | 81/9.5 |
| 3,191,464 | 6/1965 | Demler | 81/9.5 |
| 3,221,576 | 12/1965 | Goetz | 81/9.5 |
| 3,226,815 | 1/1966 | Kelly | 29/429 |
| 3,279,058 | 10/1966 | Dibble | 30/90.8 |
| 3,406,558 | 10/1968 | Tillmann et al. | 72/416 |
| 3,425,114 | 4/1969 | Fellenzer, Jr. | 29/203 |
| 3,494,171 | 2/1970 | Rapp | 72/404 |
| 3,571,888 | 3/1917 | De Fillipo | 29/203 |
| 3,596,541 | 8/1971 | Bieganski | 81/9.5 A |
| 3,611,782 | 10/1971 | Eppler | 72/410 |
| 3,710,610 | 1/1973 | McCaughey | 72/410 |
| 3,732,718 | 5/1973 | Barberio et al. | 72/410 |
| 3,837,211 | 9/1974 | Gress et al. | 72/410 |
| 3,846,894 | 11/1974 | Parsons et al. | 29/203 H |
| 3,903,725 | 9/1975 | Rommel | 72/410 |
| 3,906,561 | 9/1975 | Bawa | 7/5.4 |
| 4,025,998 | 5/1977 | Eppler | 29/566.4 |
| 4,265,016 | 5/1981 | Ducret | 30/90.8 |
| 4,387,746 | 6/1983 | Meehan | 140/105 |
| 4,713,874 | 12/1987 | Schwartz | 29/566.4 |

FOREIGN PATENT DOCUMENTS

| | | |
|---|---|---|
| 1294093 | 10/1972 | United Kingdom . |
| 1402853 | 8/1975 | United Kingdom . |

*Primary Examiner*—Z. R. Bilinsky

*Attorney, Agent, or Firm*—Morgan & Finnegan

[57] ABSTRACT

A tool for preparing multi-conductor electrical cable in a configuration for termination to and installation in a self-contained wiring device which locates the electrical cable in an anvil and a cutter assembly pierces the outer sheath of the cable and subsequently spreads the conductors of the cable as the cutter is advanced into the cable. The tool also provides flanges adapted for urging the sliced and spread apart conductors in the body of a self-contained wiring device to terminate the conductors to the device and permit closure of the device by a back cover.

14 Claims, 9 Drawing Sheets

METHOD AND TOOL FOR PREPARING MULTI-CONDUCTOR CABLE

BACKGROUND AND OBJECTS OF THE INVENTION

The invention relates to a tool for preparing a multi-conductor electrical power cable for termination to and installation in a self-contained wiring device. More particularly, the invention relates to a cable slicing and spreading tool for both slicing through the outer protective sheath of a multi-conductor electrical cable and spreading apart the conductors therein for termination to and insertion into insulation displacement terminals in a self-contained wiring device.

Multi-conductor electrical cable, having a relatively thick outer protective insulating sheath covering a bare ground and a pair of insulated conductors, is currently utilized in residential and commercial structures to distribute electrical power throughout buildings and other structures. Customarily, access to and control of the electrical current in the electrical cable is effected by connecting receptacles and switches to the cable. For certain applications, the receptacles and switches utilized in making contact with the conductors of the cable are made in the form of self-contained wiring devices, sometimes called SCD devices.

For these SCD devices, the outer protective cable sheath must be sliced to expose the ground and individual insulated conductors which are then spread apart for termination to the device. Once the conductors of the cable have been spread, the self-contained receptacles and switches can be rapidly terminated to the cable. The installation time required for termination is reduced as compared to that required for installation of conventional wiring devices because there is no need to cut or strip the insulation from the individual conductors for termination to the device since the individual conductors are terminated to the devices via insulation displacement terminals which cut through the insulation on the individual conductors to make electrical contact with the conductors.

A major factor in the installation time required for wiring the SCD devices is the time spent in preparing the cable for connection to receptacles and switches. The preparation involves slicing the outer protective insulating sheath and spreading the conductors without damaging either the electrical insulation around the conductors or the conductors themselves. Where cable preparation has been done manually, it usually involved the use of a knife to slice through the exterior sheath and spread the wires apart, with the continuing danger of injury ot the electrician.

Tools have been developed to facilitate the process of slicing the sheath and spreading the conductors but generally they have not been as facile in operation as might be desired. One such tool, disclosed in U.S. Pat. No. 3,846,894, has multiple parts pivotably connected at several points. Although the tool can function for its intended purpose, it is cumbersome to handle and awkward to operate because the various parts tend to "flop" about. Further, since the tool provides for closing the device back cover over the sliced and spread cable to force the conductors into the insulation displacement terminals, it does not permit the electrician to inspect the condition of the terminations except by reopening the device or use of a "dummy" back cover.

Another wire slicing and spreading tool is described in U.S. Pat. No. 4,025,998. Although this tool functions adequately in certain respects, it is adapted to spread the cable conductors, after the slicing operation, in two planes thereby making it difficult to connect to self-contained wiring devices. It also does not permit inspection of the termination except by reopening the device or using a "dummy" back cover.

U.S. Pat. No. 4,387,746, assigned to the present assignee and the disclosure of which is hereby incorporated by reference, describes a tool representing an improvement over previous configurations in that it does not tent to "flop" about but is still somewhat bulky and may be considered by some to be cumbersome to operate. This tool also fails to provide for ready inspection of the terminations.

Accordingly, it is an object of the present invention to provide a new and improved cable slicing and separating tool for preparing an electrical conducting cable for termination to a self-contained electrical wiring device. It is also an object of the invention to provide ;such a tool which requires relatively few independent parts to fabricate and, when assembled, has only two basic moving parts.

It is another object of the invention to provide a new and improved cable slicing and spreading tool of the foregoing type, which permits both the cable slicing and spreading function and the cable-to-device termination function to be performed by a single tool, yet enable the electrician or installer to readily inspect the terminations before the device is closed. It is a further object of the invention to provide such a tool which requires only a single pivot point and requires exertion of an generally uniform force for completing the slicing and spreading function.

It is yet another object of the present invention to provide a new and improved cable slicing and spreading tool which is comprised of a relatively few structural parts, the principal ones of which may be conveniently made by metal casting techniques.

The foregoing and other objects and advantages of the invention are set forth herein but may also be realized from the present disclosure or from practice with the invention.

SUMMARY OF THE INVENTION

Briefly described, the tool according to the present invention incorporates a cutter assembly having a plurality of cutter blades and an anvil adapted to position a multi-conductor electrical cable relative to the cutter blades for carrying out the slicing/spreading operation. The cutter assembly and anvil are each mounted to one of a pair of actuating arms which are, as preferably embodied, pivotably connected at their ends. The cutter assembly and anvil are driven towards each other by closing the actuating arms, like the jaws of a nutcracker, thereby slicing the cable sheath (in a direction parallel to the conductors therein) and thereafter spreading apart the conductors of the cable.

Advantageously, the cutter assembly and anvil are positioned relative to each other so that the slicing blades of the cutter assembly engage the cable at an angle which decreases throughout the slicing stroke, in scissor-like fashion, thereby requiring exertion of a generally uniform force over the entire slicing/spreading stroke. In addition, the slicing blades are preferably held in place by a pair of triangularly shaped blade support members which also act to spread apart the individual conductors following the slicing.

The actuating arms also include a pair of cooperating flanges, one flange adapted to hold the body of a self-contained wiring device and the other flange providing protrusions adapted to urge the individual conductors of a sliced and spread cable into the insulation displacement terminals of the self-contained wiring device and, when the actuating arms are urged towards each other, for forcing the individual conductors into the body of a self-contained wiring device and into electrical contact with the insulation displacement terminals.

However, unlike prior art tools, the condition of the resultant terminations can be readily inspected simply be separating the actuating arms again without the use of a "dummy" back cover or reopening the device. This is particularly advantageous where the device is terminated to multiple conductors in the same insulation displacement terminal. (Such termination/installation is sometimes referred to as multi-layer or multi-conductor installation.) Thus, for such a multi-conductor installation, the tool allows the first conductor to be terminated to the desired insulation displacement terminal, the tool opened, and the second conductor terminated to the same terminal without requiring a "dummy" back cover or disassembly of the SCD device.

Once the terminations have been satisfactorily made, a back cover can be manually assembled to the device.

BRIEF DESCRIPTION OF DRAWINGS

The accompanying drawings, referred to herein and constituting a part hereof, illustrate a preferred embodiment of the invention and, together with the description, serve to explain the principles of the invention, wherein.

DESCRIPTION OF THE PREFERRED EMBODIMENT

Figure 1:
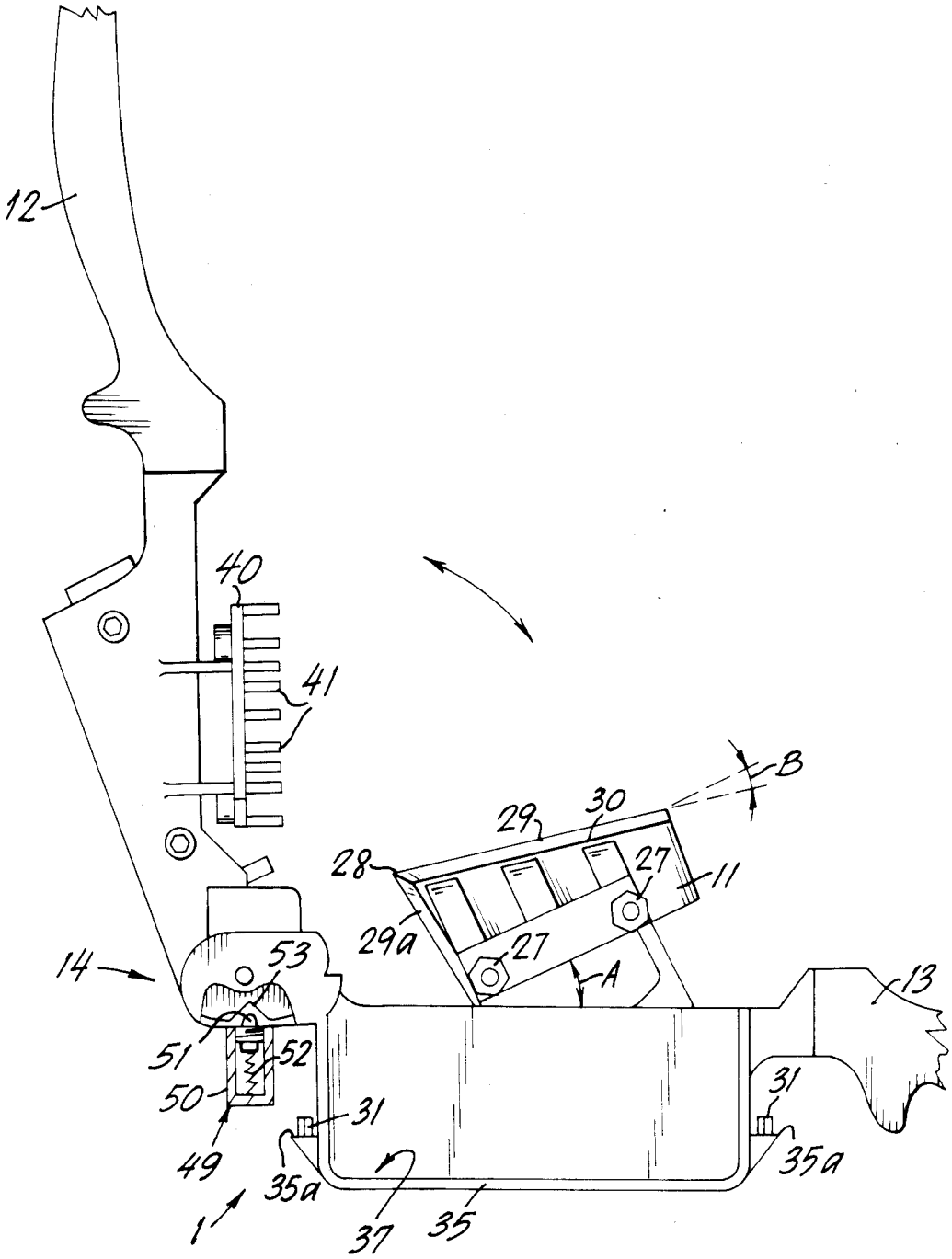
FIG. 1 is a side view of an embodiment of cable preparation tool according to the invention in the open configuration.

Referring now to the drawings which show various views of a preferred embodiment of a cable preparation tool of the present invention, a tool (indicated generally at 1) for preparing three-conductor electrical cable is shown having only five principal parts: an anvil 10, a cutter assembly 11, a pair of actuating arms 12, 13 and a device termination/closure plate 40. Advantageously, actuating arms 12, 13, anvil 10, and device closure plate 40 can be fabricated by metal casting techniques for relatively simple and inexpensive fabrication.

The actuating arms 12, 13 are pivotably connected at their ends by a pivotal coupling assembly (indicated generally at 14) with the anvil 10 mounted along one side of actuating arm 12 and the cutter assembly 11 attached to the corresponding side of the other actuating arm 13. Pivotal coupling assembly 14 is here comprised of a fork-like extension 13*a* formed on arm 13, which includes a slot 13*b* proportioned to receive a reciprocally configured extension 12*a* of arm 12 for relative pivotal movement. A bearing pin, or hinge, 14*a* extends through apertures (not numbered) formed in extensions 13*a* and 12*a* to provide the pivotal coupling between arms 12 and 13, resembling a nut-cracker-like coupling.

Advantageously, pivotal coupling 14 is adapted to provide a stop at the point of desired maximum opening of the arms 12 and 13. To this end, actuating arm 13 includes detent housing 49 which provides an internal chamber 50 to house retaining ball 51 and spring 52. The other actuating arm 12 provides notch 53 which cooperates with the ball and spring to hold the actuating arms in a predetermined open position, thereby reducing movement of the tool, while the cable or a device is being placed in the tool, to facilitate operation of the tool and reduce the risk of injury during these preparatory steps.

Figure 2:
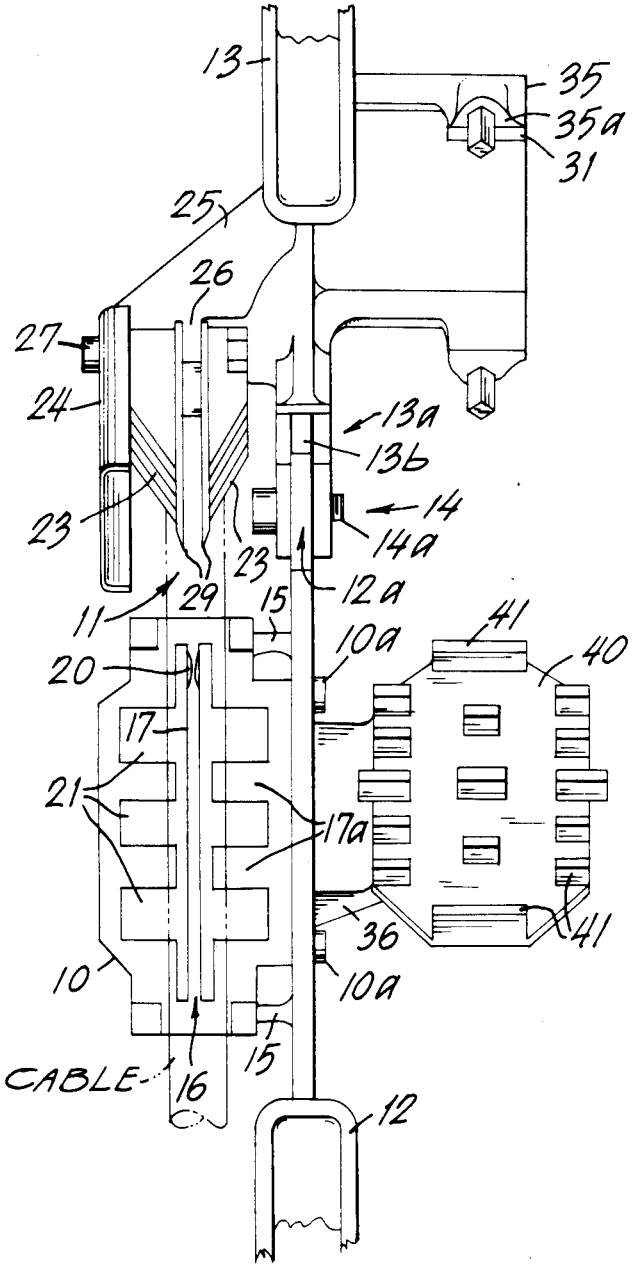
FIG. 2 is an end view of the tool shown in FIG. 1, rotated into working position, showing the anvil, cutter assembly, and flanges of the tool illustrated in FIG. 1.
Figure 4:
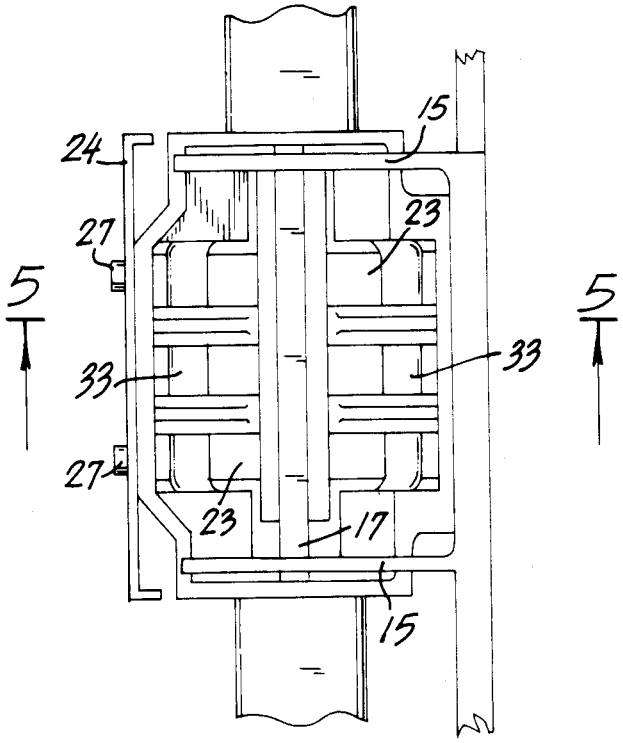
FIG. 4 is a view of the anvil and cutter assembly, looking up from underneath the anvil, showing a cable positioned within the tool after the cable slicing and the wire spreading operation have been completed.
Figure 5:
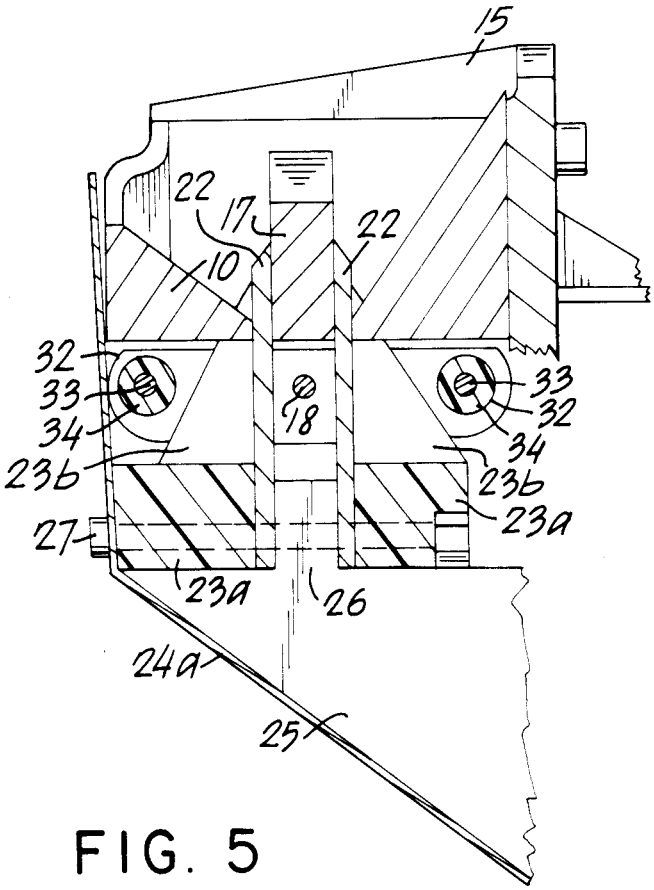
FIG. 5 is a sectional view taken along line 5—5 of FIG. 4 showing the spread-apart cable conductors within the tool.
Figure 6:
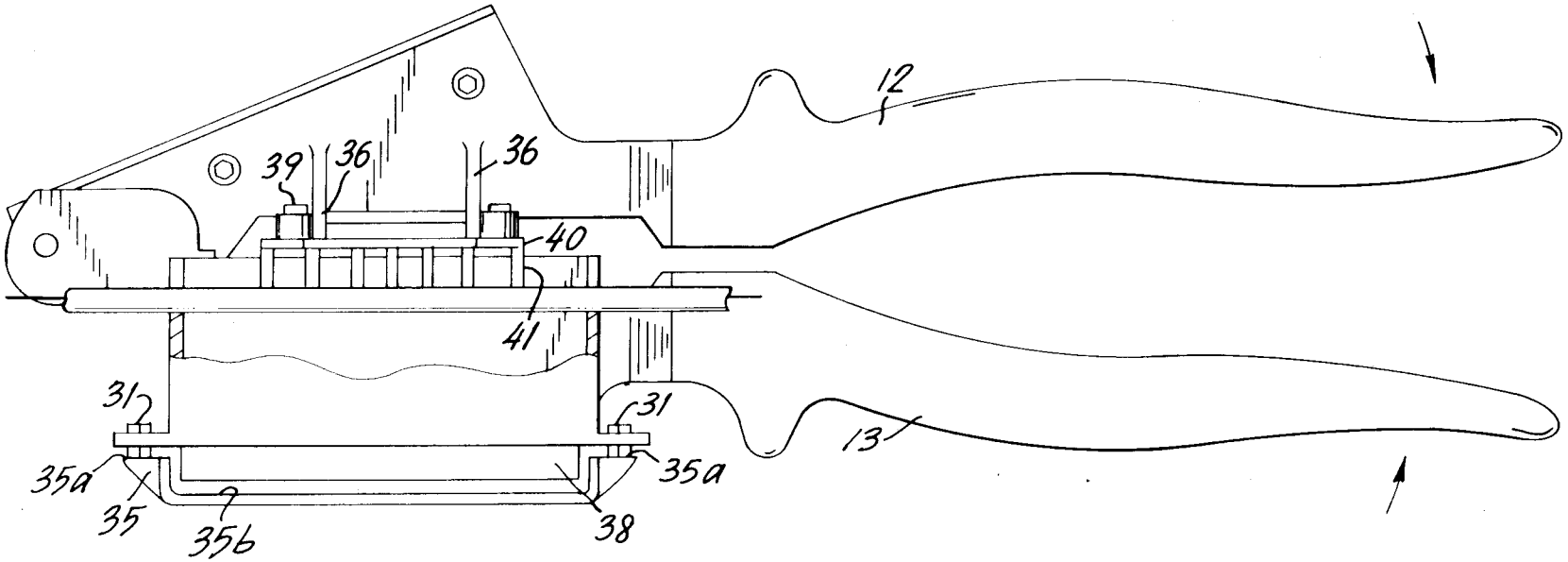
FIG. 6 is a side view of the tool showing a cable and an SCD device positioned within the flanges.
Figure 7:
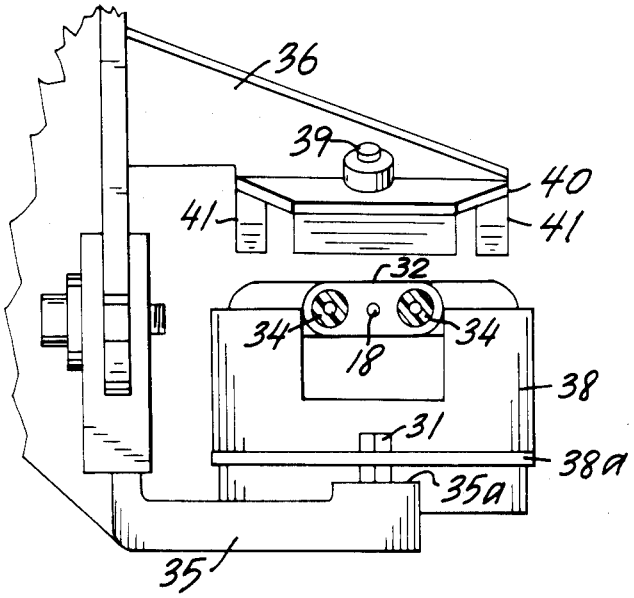
FIG. 7 is an end view showing the cable and device of FIG. 8 just prior to urging the conductors into the device.
Figure 8:
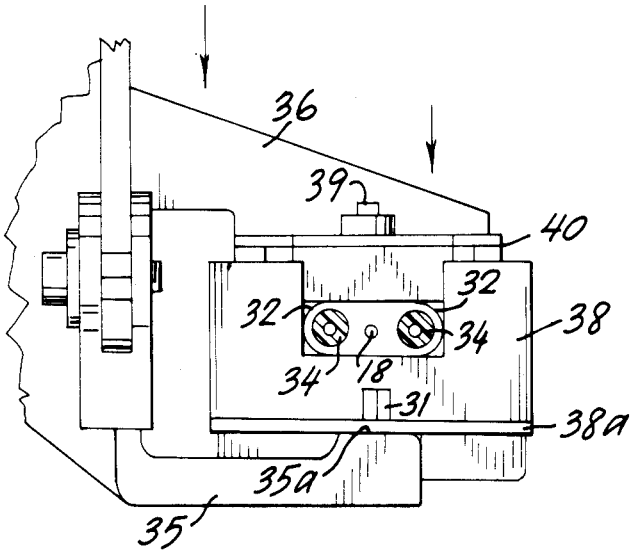
FIG. 8 is an end view similar to FIG. 7 showing the cable and device after the conductors have been urged into the device.

The anvil 10 is supported on a pair of cantilever-like anvil supports 15 which are preferably formed integrally with, and extend outwardly from, actuating arm 12 (FIGS. 2, 4 and 5). The anvil may be secured to arm 12 by threaded fasteners 10*a* which extend through openings (not numbered) formed in the arm 12 and into threaded holes 19 formed in the side of the anvil. Advantageously, the anvil supports 15 are adapted to support the anvil at an angle of about 25°–35° with respect to the actuating arm 12. (This angular relation will be more evident from the discussion below with reference to FIG. 10*a*.)

It will be understood that the resulting angular relation between the cable supporting surface of the anvil and actuating arm 12 facilitates handling of the tool and locating of the cable prior to the slicing/spreading operation. Since a loop of cable is pulled through the wall opening, the anvil can be held in a generally vertical orientation for locating the cable, while the arm 12 extends angularly away from the vertical (by about 30°) for easier handling by the electrician.

Figure 3:
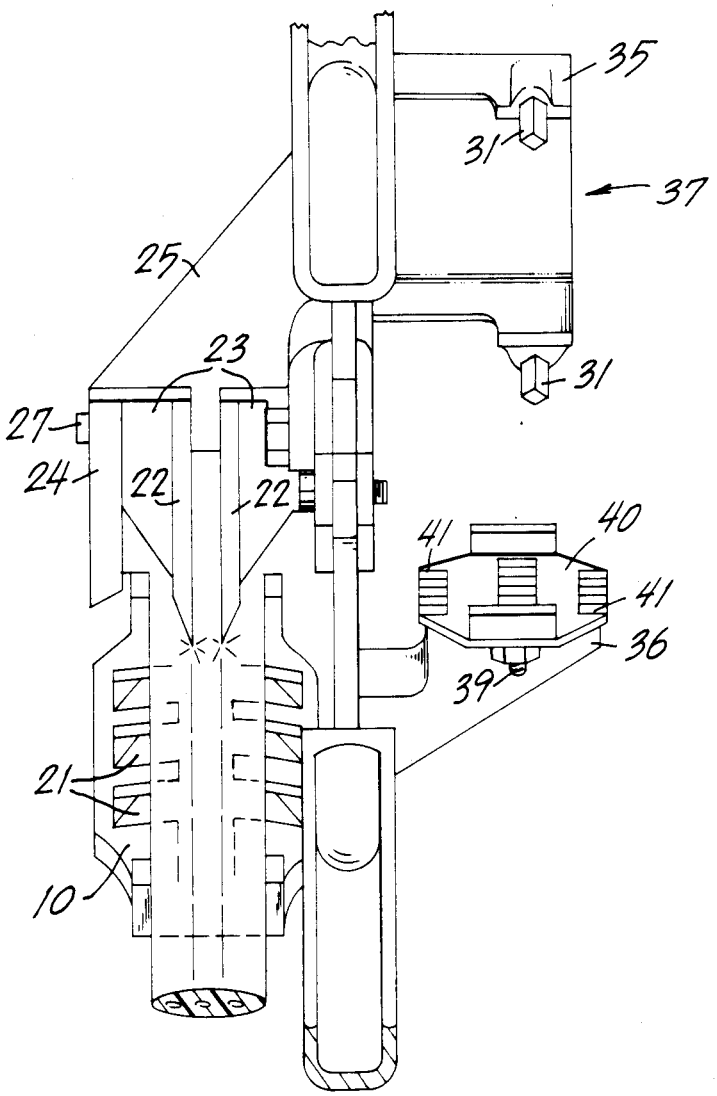
FIG. 3 is an end view, similar to that of FIG. 2, showing a cable positioned within the tool prior to the slicing operation.
Figure 3A:
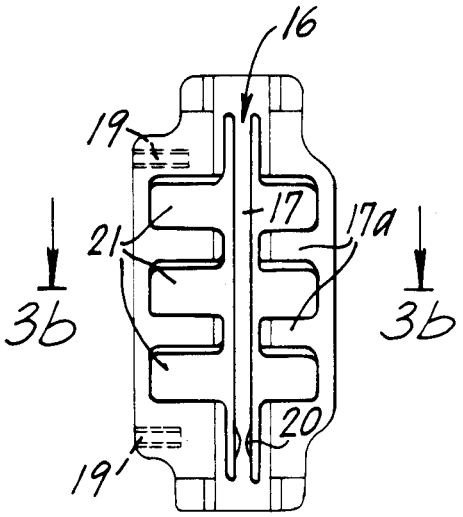
FIG. 3*a* is a plan view looking downwardly at the anvil.
Figure 3B:
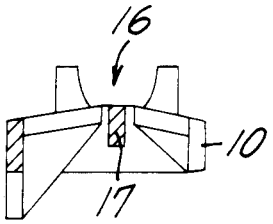
FIG. 3*b* is an end view taken along line 3*b*—3*b* of the anvil of FIG. 3*a*.

Advantageously, and as preferably embodied, anvil 10 is adapted to support a cable to be prepared during the slicing and spreading function. To this end, each end of the anvil includes a slot 16 (best seen in FIGS. 3*a* and 3*b*) to receive and locate the cable during these operations, and it includes a slotted support surface adapted to permit the slicing blades and spreader-support members (described more fully below) to pass there through. Thus, the anvil 10 includes central support rib 17 which extends the length of the anvil and is formed by a slot adapted to permit passage of the slicing blades on either side of rib 17. Anvil 10 also includes a plurality of slots (each indicated at 21) which correspond in number, shape and location to the triangularly-shaped spreader/-blade-support elements. It will be understood that slots 21 form a plurality of projecting support fingers (each indicated at 17*a*) on the anvil for helping support the cable during the initial slicing operation and for supporting the individual conductors during the cable spreading operation.

Advantageously, support rib 17 is of a width slightly greater than the diameter of the center ground conductor 18 of the cable and may include concave notches 20 at one end to facilitate penetration of the slicing blades at the point of the initial cut into the cable sheath.

Figure 10A:
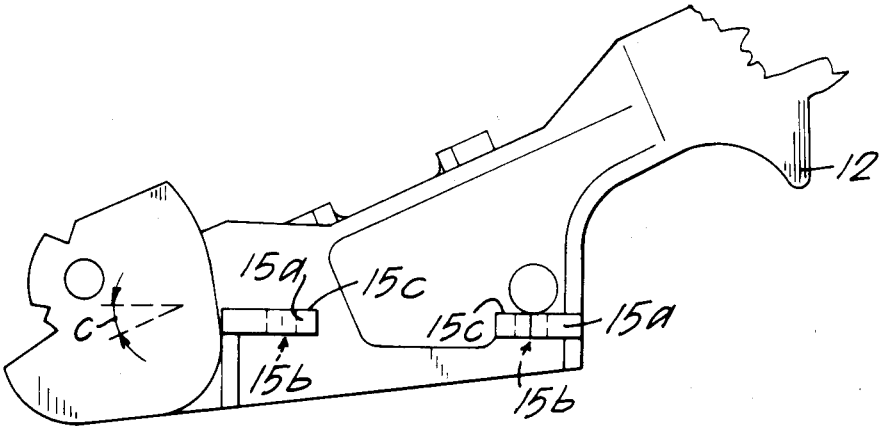
FIG. 10*a* is a side view of an alternate preferred embodiment of the anvil mounting means.
Figure 10B:
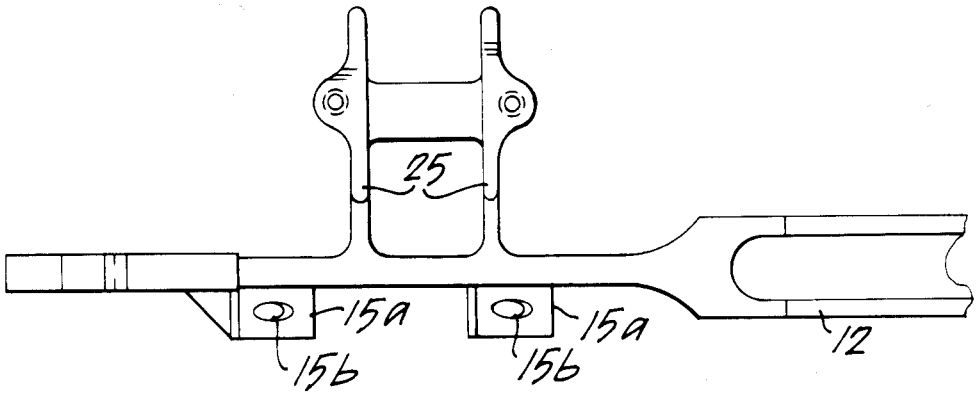
FIG. 10*b* is a plan view of an alternate preferred embodiment of the anvil mounting means.

Referring now to FIGS. 10*a* and 10*b*, there is shown an alternate preferred embodiment of the mounting means on actuating arm 12 for mounting the anvil. As here embodied, actuating arm 12 includes relatively short, cantilever mounted mounting supports 15*a* instead of cantilever arms 15 which are preferably formed integrally with arm 12. Mounting supports 15*a* include holes 15*b* formed therein to accommodate threaded fasteners (not shown) to fasten anvil 10 to the mounting supports. Advantageously, holes 15*b* are oversized to allow adjustment of the anvil position and alignment with the blades of the cutter assembly 11 prior to final assembly by tightening down the threaded fasteners. As indicated above with respect to FIGS. 2, 4 and 5, the mounting supports 15*a* are mounted so that the mounting surfaces 15*c* of mounting supports 15*a* may form an angle (indicated at C) with respect to arm 12 of about 25°-35° thereby facilitating handling of the tool and locating of the cable in the anvil, as described above.

Figure 11A:
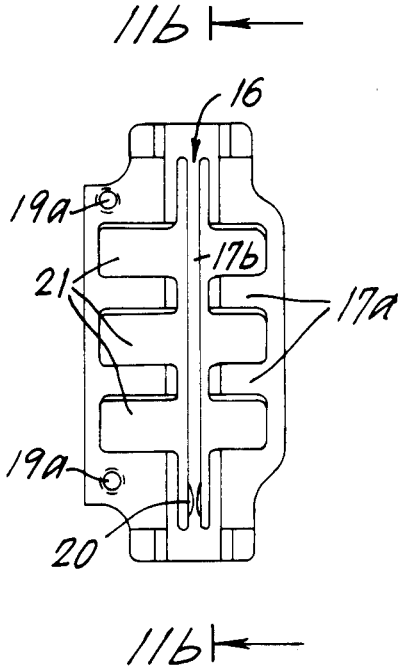
FIG. 11*a* is a plan view looking downwardly at an alternate preferred embodiment of the anvil.
Figure 11B:
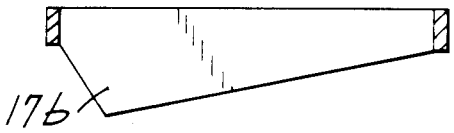
FIG. 11*b* is an end view taken along line 11*b*—11*b* of the anvil of FIG. 11*a*.

FIGS. 11*a* and 11*b* show an alternate preferred embodiment of anvil 10 which is adapted to be installed on supports 15*a* of the alternate preferred mounting means. To this end, such threaded mounting holes 19*a* are formed in the anvil. Also illustrated in FIG. 11*b* is an alternate preferred embodiment of anvil rib 17*b*. As here embodied, the bottom rib 17*b* projects downwardly and extends at an angle so as to follow the slope of the cutting edges of cutter blades 22 when the tool is closed. As preferably embodied, the bottom edge of rib 17*b* projects downwardly at least as far as the cutting edges of blades 22 when the tool is closed so that the cutting edges are not left exposed to risk possible injury.

The cutter assembly 11, as here embodied, comprises a pair of cutter blades 22, a pair of tapered blade supports 23, and a cutter shield 24. The cutter assembly is mounted to arm 13 by a pair of cantilever-like cutter assembly supports 25 which are integrally formed with arm 13 for supporting the cutter assembly. A blade spacer 26 is formed as part of the assembly supports 25 for maintaining a predetermined spacing between the slicing blades. Advantageously, the blade spacer 26 comprises a rib-like strut extending between (and preferably formed integrally with) the two cutter assembly supports 25. The cutter blades 22 are secured on opposite sides of blade spacer 26 by a pair of nut-and-bolt fasteners (indicated generally at 27) which extend through the tapered blade supports, the blades themselves, and the blade spacer 26. Each of the cutter blades 22 provides a leading tip 28 and a principal cutting edge 29. If desired, the front edge 29*a* may also form a cutting edge to ensure complete slicing. However, as described below, with appropriate selection of angles, only edge 29 need provide a cutting edge to economize on fabrication costs. Chamfers 30 on the cutter blades facilitate the formation of the cutting edge.

As can be seen in FIG. 2, the cutter blades 22 are positioned such that the cutting edge 29 of each blade is spaced from the corresponding cutting edge of the other cutter blade a distance slightly greater than the width of the support rib 17 of the anvil. In addition, the cutter blades are preferably mounted such that their cutting edges 29 are essentially parallel to each other. (It will also be appreciated therefore, that the adjustment capability provided by the mounting supports disclosed with reference to FIGS. 10a and 10b is particularly advantageous in view of the relatively small distance between the blades.) A cutter shield 24, with depending leg segment 24*a* is advantageously mounted to the tool on the outside of the cutter assembly to prevent access to the cutter blades by a person's fingers and avoid possible injury to the operator. Shield 24 may be secured on the outside of the cutter assembly by the same fasteners, 27, which secure the cutter assembly to arm 13.

Advantageously, blade supports 23 are made of a low friction plastic material such as DELRIN 500. Each support includes a base segment 23*a* adapted to be secured to cutter assembly support 25 by the pair of nut and bolt fasteners 27 which extend through (i) the support base sections 23*a*, (ii) the bottoms of the slicing blades, and (iii) the blade spacer 26 (which is preferably formed integrally with supports 25) to hold the cutter assembly in place. The supports also preferably include a series of upstanding triangular (in cross-section) segments adapted to penetrate the space between the ground wire of the cable and one of the conductors for completing the wire separation function. The triangular segments (here, three in number) are formed in slightly diminishing heights beginning with the one adjacent leading tip 28 so as to be generally equidistant from the cutting edge 29. It will be understood that the support members 25 and cutter assembly are proportioned so that the slicing edge 29 pierces the cable sheath at a generally decreasing acute angle relative to the top edge of rib 17 in generally scissor-like action which results in a relatively uniform force exertion over the slicing stroke.

As here embodied, the support surface provided by support members 25 forms an angle, indicated at A (FIG. 1), of about 25° with respect to the axis of arm 13 and the cutting edge 29 may form an angle, indicated at B (FIG. 1), of about 8° and the angle at tip 28 is about 74°. However, by decreasing the angle of the tip 28 to about 68°-70°, any need to sharpen edge 29*a* is obviated. This results in economies in fabrication of the cutter blades. In either arrangement, due to the scissor-like action of the present invention, the force required to slice the cable insulation will be less than that of existing tools which use chevron shaped cutting edges that are forced into the insulating sheath.

In operation, a cable to be prepared for termination to and installation in an SCD device is placed in the center slot 16 of the anvil 10 to position the center ground conductor 18 in alignment with the support rib 17 of the anvil and the space between the cutter blades 22. By manually closing the actuating arms 12, 13, bringing them toward each other, the cutter assembly moves toward the anvil with the cutter blades advancing against the cable located on the anvil. The tips 28 of the cutter blades 22 are the first to engage the cable. They penetrate the outer cable sheath 32, with the tips penetrating the space between an insulated conductor 33 and the central ground conductor 18. As preferably embodied, the spacing between the tips of the cutter blades is selected so as not to pierce the insulating covers 34 of the conductors 33 so that they are left undamaged during penetration of the sheath 32. (For #12 or #14 cable, the blades may be spaced about ⅛" apart.)

By closing the actuating arms 12, 13 further towards each other, the cutter blades continue to advance into the cable to complete slicing the cable sheath. Simultaneously, tapered blade supports 23 begin to penetrate between the ground and the two conductors of the cable, urging the conductors away from the ground. Thus, it will be understood that the cable slicing and wire separating functions are carried out simultaneously during a single closure stroke of the tool. In addition, because of the nut-cracker-like arrangement and angular relation of parts, the force necessary to complete this function is generally uniform over the closure stroke after the initial cable slicing penetration of blade tips 28.

After the closure stroke is completed, the conductors are fully separated as shown in FIG. 5. Thereafter, the tool is opened and the cable can be removed for installation in an SCD device.

According to another aspect of the invention, the actuating arms that support the anvil and cutter assembly also preferably support flanges 35 and a pair of cantilever-like members 36 which collectively provide another support flange. In addition to the functions of the tool previously described, these flanges serve as a vise-like device for carrying out the termination and installation of a sliced and spread cable in a self-contained wiring device such as that described in U.S. Pat. No. 4,500,746, entitled "SELF-CONTAINED ELECTRICAL WIRING DEVICE", assigned to the present assignee, the disclosure of which is hereby incorporated by reference.

Referring now to FIGS. 6–9, the lower flange 35 provides a recessed channel 37 adapted to allow the body portion of a self-contained wiring device 38 (whether its front face is in the configuration of a switch device or an outlet receptacle) to be supported thereby for the wire termination/installation operation. Locator pillars 31 are provided on pillar bases **35*a* of the lower flange 35 to protrude through openings formed in the device mounting strap 38*a* for receiving wall plate mounting tabs and to insure proper alignment of the device in the tool. Pillar bases 35*a* of lower flange 35 are spaced upwardly (approximately ¼" to ⅛") from flange base 35*b* so as to allow room for the switch paddle (when device 38 is switch device) even after the tool is fully closed. Thus, the device is supported on the pillar bases 35*a* by its mounting straps 38*a*** to leave room for the switch paddle if the device is a switch.

Figure 9:
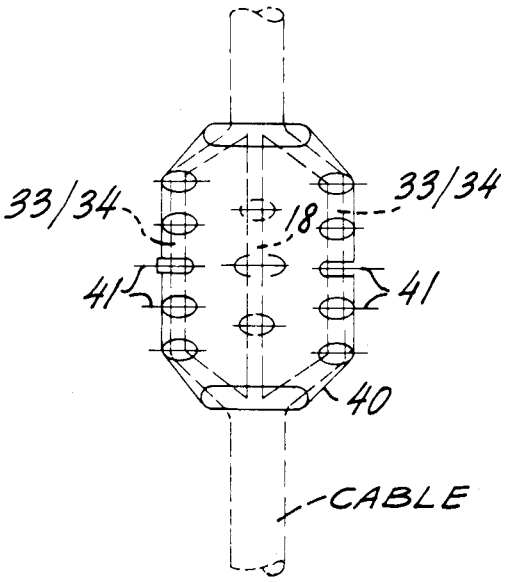
FIG. 9 is a plan view looking upwardly at the upper flange with the sliced/spread cable in phantom top illustrate how it urges the cable conductors into the device.

The top flange-pair 36 has attached to it by machine screws 39 a plate 40 providing protrusions 41 positioned to correspond in location to the conductors 18, 33 of the sliced and spread cable (as shown in FIG. 9) for urging them into engagement with the insulation displacement terminals in the device. The protrusions must of course, project sufficiently to force the conductors into the insulation displacement terminal and insure good electrical contact is made.

The sliced and spread portion of the cable is placed over the insulation displacement terminal portions of the contacts which are exposed at the back of the body, substantially as described in the aforesaid U.S. Pat. No. 4,500,746. As the actuating arms 12, 13 are brought toward each other, the protrusions 41 contact the conductors 18, 33, and urge the conductors 18, 33 into the slots of the insulation displacement terminals and, as the tool is fully closed, the conductors are urged into full electrical contact with terminals so as to electrically terminate the conductors to the terminals. Once the tool has been closed, the termination procedure is complete, and the tool can be opened to reveal the back of the device with the cable in place. It will be appreciated that this allows the operator of the tool to inspect the quality of the cable termination in the self-contained wiring device before its final closure and/or to then terminate/install another conductor if there is to be a multi-layer installation. (Thereafter, the back cover can simply be secured to the device by hand.)

Heretofore, either the device back cover was used to force the conductors into the device, or a "dummy" back (i.e., with locking tabs removed) was used to carry out the termination installation step (with consequent locking of the back cover to the device body). In the former, the device back would have to be disassembled in order to inspect the condition of the terminations, while in the latter, the electrician would have to carry around the "dummy" back which could be lost or misplaced. Thus, the tool of the present invention serves the two-fold function of slicing the cable and spreading the conductors and then terminating/installing the sliced and spread cable to the self-contained wiring device without the inconvenience of either of the foregoing methods.

It is to be understood that the above-described embodiment of the invention is illustrative only and that modifications thereof may be made without departing from the scope and spirit of the invention. Thus, for example, plate 40 could be formed integrally with tool arm 12, but it is preferred that it be formed separately for ease of replacement in case of breakage or need for a different pattern of protusions 41.

What is claimed:

1. A tool for slicing through the outer protective sheath of an electrical power cable and spreading apart individual conductors of the cable, said tool comprising:

a pair of arm members pivotally connected at one end and having hand-gripping portions near their other ends;

a cutter assembly mounted to one of said arm members, said cutter assembly including a pair of parallel cutter blades each having a principal cutting edge, with a spacer therebetween to maintain a predetermined spacing between the blades and a pair of triangularly shaped spreader/blade-support members both for mounting the blades to the tool about the spacer, and also for causing individual conductors of the cable to be spread away from its central ground during closure of said arms; and an anvil member mounted to the other of said arm members for co-action with the cutter assembly when the tool is closed, said anvil providing a cable support surface for supporting the cable during the sheath slicing and conductor spreading operations, and said anvil including (i) means for locating the cable in proper orientation relative to said cutter blades when said tool is closed, (ii) a central support rib extending parallel to the cable when properly located on said anvil to support a central conductor of the cable during the sheath slicing and conductor spreading operation, and (iii) slots on either side of said central support rib, said slots proportioned to permit the cutter blades and spreader/blade-support members to pass through the cable support surface while the cable remains supported thereon;

wherein said cutter assembly is mounted to the tool such that the principal cutting edges move past the anvil support surface at a gradually decreasing angle, in scissor-like manner, for a generally uniform force exertion over the slicing and spreading stroke of the tool wherein each said spreader/blade-support member includes a base segment and a plurality of triangularly shaped segments upstanding therefrom, and wherein said spacer is formed integrally with the tool arm member to which said cutter assembly is mounted, such that said cutter assembly is mounted to the tool by direct attachment to the spacer.

2. A tool according to claim 1, wherein said cutter blades are generally rectangular in configuration and have a leading tip at one corner with the principal cutting edge formed along a long side of the blade adjacent the leading tip, but wherein the angle formed at the leading tip and the angle of inclination of the principal cutting edge are selected such that all slicing of the sheath is carried out substantially only by the principal cutting edges.

3. A tool according to claim 1, wherein said anvil is supported by a pair cantilever-like support members projecting outwardly from the arm member to which the anvil is mounted.

4. A tool according to claim 3, wherein said anvil support members are relatively elongated and said anvil is secured to its adjacent arm member by a fastener extending through such arm member.

5. A tool according to claim 3, wherein said anvil is secured directly to said anvil support members by fasteners extending through said anvil support members.

6. A tool according to claim 5, wherein each said anvil support member is formed with an oversized opening for receiving the fasteners to permit the position of the anvil to be adjusted prior to tightening the fasteners while they extend through said oversized openings.

7. A tool according to claim 1, wherein said slots in said anvil are proportioned to form finger-like support projections with spaces between each finger-like member to permit passage of the triangularly shaped spreader/support members.

8. A tool according to claim 1, wherein said central rib of said anvil extends downwardly at least as far as the cutting edges of the cutter assembly when the tool is fully closed to prevent injury to a user of the tool.

9. A tool for slicing through the outer protective sheath of an electrical power cable and spreading apart individual conductors of the cable, said tool comprising:

a pair of arm members pivotally connected at one end and having hand-gripping portions near their other ends;

a cutter assembly mounted to one of said arm members, said cutter assembly including a pair of parallel cutter blades each having a principal cutting edge, with a spacer therebetween to maintain a predetermined spacing between the blades and a pair of triangularly shaped spreader/blade-support members both for mounting the blades to the tool about the spacer, and also for causing individual conductors of the cable to be spread away from its central ground during closure of said arms; and an anvil member mounted to the other of said arm members for co-action with the cutter assembly when the tool is closed, said anvil providing a cable support surface for supporting the cable during the sheath slicing and conductor spreading operations, and said anvil including (i) means for locating the cable in proper orientation relative to said cutter blades when said tool is closed, (ii) a central support rib extending parallel to the cable when properly located on said anvil to support a central conductor of the cable during the sheath slicing and conductor spreading operation, and (iii) slots on either side of said central support rib, said slots proportioned to permit the cutter blades and spreader/blade-support members to pass through the cable support surface while the cable remains supported thereon;

said tool further including, on the side of the tool opposite from said cutter assembly and anvil, a wiring device support member and a wiring device press member on opposite arm members for terminating spread apart cable conductors to a wiring device and installing the cable in the device, wherein said wiring device support member comprises a flange mounted to an arm member, said flange including a pair of pillar base members with a pillar projecting upwardly from each said pillar base, said pillars being positioned and proportioned to be snugly received within openings formed at either end of a mounting strap on a wiring device to be terminated to spread apart cable conductors, thereby to support the device by its mounting strap on said pillar base members during the termination operation.

10. A tool according to claim 9, wherein said press member is configured with projections positioned and proportioned to urge the spread apart cable conductors into insulation displacement electrical terminals in the device for terminating the conductors to the device.

11. A tool according to claim 9, wherein said pillar base members are proportioned to space the device from other structures on the tool whether the device is a receptacle or switch device.

12. A tool according to claim 1 wherein said anvil support surface extends at an angle relative to the arm member to which said anvil is mounted to facilitate holding the tool while the cable is positioned on said anvil in preparation for the slicing and spreading operation.

13. A tool according to claim 12, wherein said angle is from about 25° to about 35°.

14. A tool for slicing through the outer protective insulating sheath of an electrical power cable, and spreading apart individual conductors of the cable, and for terminating the spread apart conductors to insulation displacement terminals in a wiring device and installing the conductors in the device, said tool comprising:

a pair of arm members pivotally connected at one end with hand-gripping portions near their other ends, said pivotally connected arm members being adapted to be closed and opened by moving the arm members towards and away from each other, said arm members fixedly carrying (i) a cutter assembly and an anvil assembly on one side of opposite arm members to be advanced towards each other during closure of said arm members of simultaneously carrying out the insulation slicing and conductor spreading operation; and (ii) a wiring device support member and a wire termination press member on the other side of opposite arm members for carrying out the conductor termination and installation operation, such that the sheath slicing, cable spreading and conductor termination and installation operations can be carried out by a single, relatively compact tool, with only two pivotally connected moving parts in nut-cracker-like manner with said cutter assembly, anvil, device support member and press member all being mounted to said arm members between their pivotal connections and hand gripping portions of said tool.

* * * * *